US006588962B1

(12) United States Patent
Schmitt

(10) Patent No.: US 6,588,962 B1
(45) Date of Patent: Jul. 8, 2003

(54) GAP CHECKING DEVICE WITH AUTOMATIC PAINT APPLICATION

(75) Inventor: David Schmitt, Troy, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,273

(22) Filed: Mar. 26, 2002

(51) Int. Cl.[7] ..... B43K 5/00
(52) U.S. Cl. ..... 401/205; 401/206; 73/1.01
(58) Field of Search ..... 401/264, 263, 401/265, 266, 205, 206; 73/1.88, 1.01; 33/700, 701, 783

(56) References Cited

U.S. PATENT DOCUMENTS

| | | | | |
|---|---|---|---|---|
| 3,091,374 A | | 5/1963 | Schwartzman | |
| 3,472,102 A | | 10/1969 | Dunlap et al. | |
| 3,661,040 A | | 5/1972 | Lesner | |
| 3,750,729 A | | 8/1973 | Lemieux | |
| 4,301,698 A | | 11/1981 | Saint Georges Chaumet | |
| 4,364,684 A | * | 12/1982 | Kohno et al. | 401/264 |
| 4,719,825 A | | 1/1988 | LaHaye et al. | |
| 4,993,859 A | * | 2/1991 | Assad et al. | 401/264 |
| 5,087,138 A | * | 2/1992 | Terbrusch et al. | 401/206 |
| 5,332,326 A | | 7/1994 | Hori | |
| 5,387,046 A | | 2/1995 | Danno | |
| 6,112,626 A | | 9/2000 | Risner et al. | |
| 6,135,659 A | | 10/2000 | Ku | |
| 6,332,383 B1 | | 12/2001 | Komatsu | |

* cited by examiner

*Primary Examiner*—David J. Walczak
(74) *Attorney, Agent, or Firm*—Rankin, Hill, Porter & Clark LLP; Alan T. McDonald; Vincent Ciamacco

(57) ABSTRACT

A gap checking device includes a housing, a plunger, and a paint applicator. The housing defines a paint reservoir in which a proximal end of the plunger is received. The plunger is movable between a closed position sealing the reservoir and an open position permitting the release of paint from the reservoir. When the plunger is open, paint flows along the plunger toward a distal end of the plunger. The paint applicator, which is disposed near the distal end of the plunger, is specially shaped and sized to check a gap between a pair of surfaces, such as the gap in an end surface of a control shaft. To check the gap, the distal end of the plunger is inserted into the gap, and the device housing is forced toward the end surface. The distal end of the housing moves axially toward the end surface of the control shaft. If the gap is not too small, the end surface of the control shaft engages the paint applicator and is thereby coated with paint. If the gap is too small, the plunger engages a stop carried by the housing before the end surface engages the paint applicator, thereby preventing the application of paint to the control shaft end surface.

22 Claims, 2 Drawing Sheets

GAP CHECKING DEVICE WITH AUTOMATIC PAINT APPLICATION

BACKGROUND OF THE INVENTION

1. Field of the Invention

The present invention generally relates to gap checking devices and, more particularly, toward gap checking devices that automatically mark surfaces to indicate that the correct gap has been set.

2. Description of Related Art

In manufacturing processes it is sometimes necessary to check a gap to make sure that it is properly set. For example, in some manufacturing or assembly processes, it is necessary to check a gap in the end of a control shaft for quality control purposes. Conventionally, this check is done using a hand tool having an end profile corresponding to the desired gap. The hand tool includes a foam tip to which a user manually applies paint. When a control shaft end gap is determined to be satisfactory, the foam tip is wiped over the end surface of the control shaft to mark the control shaft such that others can determine that the control shaft end gap has passed the quality control check.

Unfortunately, manual application of paint to the foam tip is a time consuming process that must be repeated frequently. Accordingly, use of the prior art device slows down the gap checking process and, should the foam tip be dry, may result in the control shaft being insufficiently marked.

Therefore, there exists a need in the art for a gap checking device that facilitates the gap checking and control shaft marking process. There further exists a need in the art for a method of checking and marking control shafts that can be accomplished simply and rapidly.

SUMMARY OF THE INVENTION

The present invention is directed toward an integrated gap checking and paint applicator device. The present invention is further directed toward a method of checking gaps and marking control shafts that is simply and rapidly accomplished.

In accordance with the present invention, a gap checking device includes a housing, a plunger, and a paint applicator. The housing defines a paint reservoir in which the plunger is movable between a closed position sealing the reservoir and an open position permitting the release of paint from the reservoir. When the plunger is open, paint flows along the plunger toward a distal end of the plunger.

In further accordance with the present invention, the paint applicator is disposed near the distal end of the plunger. The plunger distal end is specially shaped and sized to check a gap between a pair of surfaces, such as the gap in an end surface of a control shaft. To check the gap, the distal end of the plunger is inserted into the gap, and the device housing is forced toward the end surface. The distal end of the housing moves axially toward the end surface of the control shaft. If the gap is correct, the end surface of the control shaft engages the paint applicator and is thereby coated with paint. If the gap is too small, the plunger engages a stop carried by the housing before the end surface engages the paint applicator, thereby preventing the application of paint to the control shaft end surface. Accordingly, the inventive device simultaneously checks the end gap and marks the adjacent surface when the end gap is properly set.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
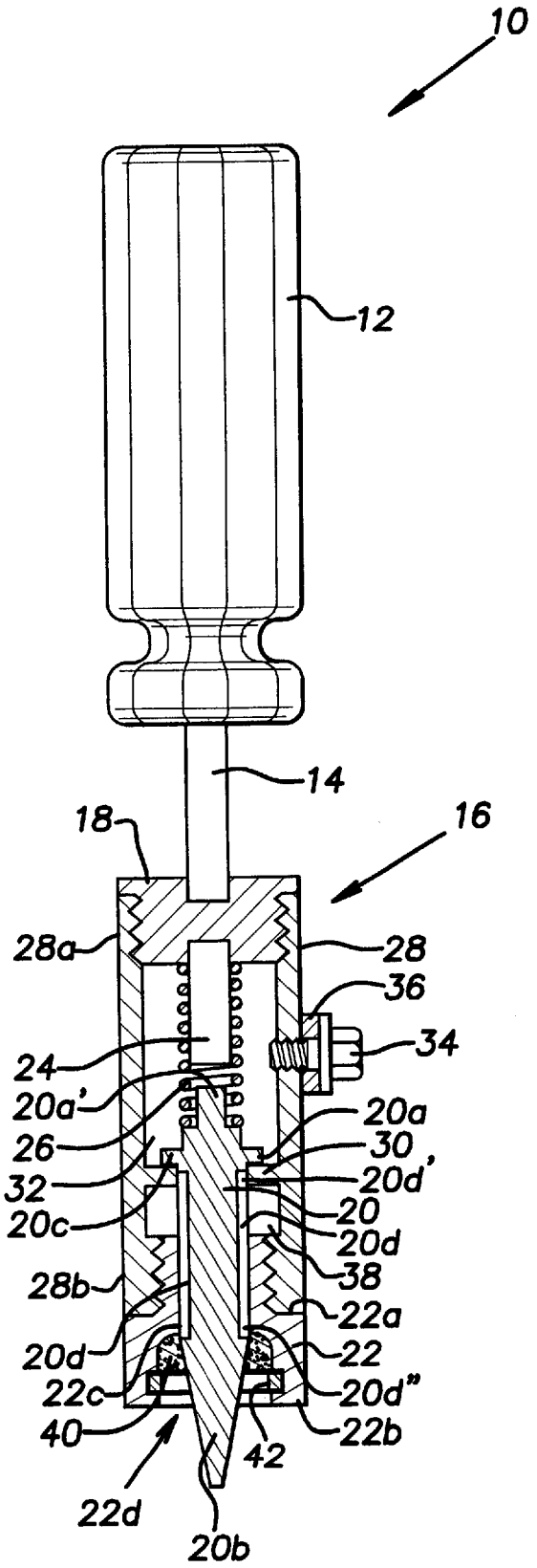
FIG. 1 schematically illustrates a gap checking device according to the present invention.

With reference to FIG. 1, the gap checking device 10 according to the present invention is shown to include a handle 12, a shaft 14, a housing 16, an end cap 18, a plunger 20, and a guide plug 22. The shaft 14 extends from the handle 12 and is embedded in the end cap 18. An inner surface of the end cap 18 has a stop post 24 extending therefrom. The stop post 24 has a first end of a return spring 26 secured thereover, as illustrated. Preferably, the end cap 18 is permanently secured to the shaft 14 so that the shaft 14, handle 12, end cap 18, and stop post 24 are linked for common rotation and can be affixed as a unitary structure to the housing 16. In the illustrated embodiment the stop post 24 is a separate piece. However, it is contemplated that the stop post 24 could be provided by having the shaft 14 extend through the end cap 18.

The housing 16 has a generally cylindrical sidewall 28 and an internal annular wall 30. The sidewall 28 has a first end 28*a* and an opposite second end 28*b*. The first end has a threaded inner surface to which the end cap 18 is threadingly and sealingly secured. In some applications it may be desirable to permanently attach the end cap 18 to the first end 28*a* of the sidewall 28, such as by adhesive. The sidewall second end 28*b* also has a threaded inner surface that threadingly and sealingly receives the guide plug 22. The annular wall 30 extends radially inwardly from the inner surface of the sidewall 28 at a location intermediate the first and second ends 28*a*, 28*b*, and defines a central opening through which the plunger 20 slidably extends.

The end cap 18, internal annular wall 30, and cylindrical sidewall 28 of the housing cooperate to define a primary paint reservoir 32. A fill plug 34 threadably and sealably extends through the cylindrical sidewall 28 to permit filling of the primary reservoir 32 with paint. An O-ring 36 is preferably provided to seal the fill plug 34 to the sidewall 28, as illustrated.

A secondary paint reservoir 38 is provided beneath the annular wall 30. More specifically, the annular wall 30, cylindrical sidewall 28, and guide plug 22 cooperate to define the secondary paint reservoir 38.

The guide plug 22 has a threaded proximal end 22*a* and a relatively enlarged distal end 22*b*. The proximal end 22*a* of the guide plug 22 is sealingly threaded into the second end 28*b* of the cylindrical sidewall 28, as discussed hereinbefore. The distal end 22*b* of the guide plug 22 includes an annular face that is directed toward the second end 28*b* of the cylindrical sidewall 28 and is in face-to-face sealing contact with an annular surface at the distal end of the cylindrical sidewall 28, as illustrated. The guide plug 22 also defines a bore 22*c* and an inner cavity 22*d* into which the bore 22*c* issues. The bore 22*c* communicates with the secondary paint reservoir 38 and slidably receives and guides the plunger 20 as the plunger moves axially during use of the device 10, to be described hereinafter.

The inner cavity 22*d* receives a ring-shaped foam paint applicator 40. A semi-circular spring clip 42 is received in a groove formed in the guide plug 22 adjacent the foam paint applicator 40 and serves to releasably retain the paint applicator 40 within the inner cavity 22*d*.

The plunger 20, which is elongated and generally cylindrical in shape, has a proximal end 20*a* disposed within the primary paint reservoir 32 and a distal end 20*b* projecting from the guide plug 22. The plunger distal end 20*b* has a frusto-conical surface that serves as a gap-checking surface. The distal end 20*b* will be specifically sized and shaped to match the desired parameters of the opening into which the distal end is inserted.

The plunger proximal end 20*a* includes a reduced diameter portion 20*a'* over which a second end of the return spring 26 is disposed. Adjacent the proximal end, the plunger includes an annular rim 20*c* that extends radially and serves as a stop that is adapted to sealingly engage a surface of the interior annular wall 30 surrounding the central opening therein. Between the annular rim 20*c* and the projecting distal end 20*b* the plunger 20 has a series of longitudinally extending grooves 20*d* formed therein. The grooves 20*d* have an upper end 20*d*' disposed just beneath the annular rim 20*c* and a lower end 20*d*" disposed within the guide plug 22 and adjacent the foam paint applicator 40. The grooves 20*d* define flow channels by means of which paint from the primary paint reservoir 32 may flow to the secondary paint reservoir 38 and then to the foam applicator 40, as will be apparent from the following discussion.

Figure 2:
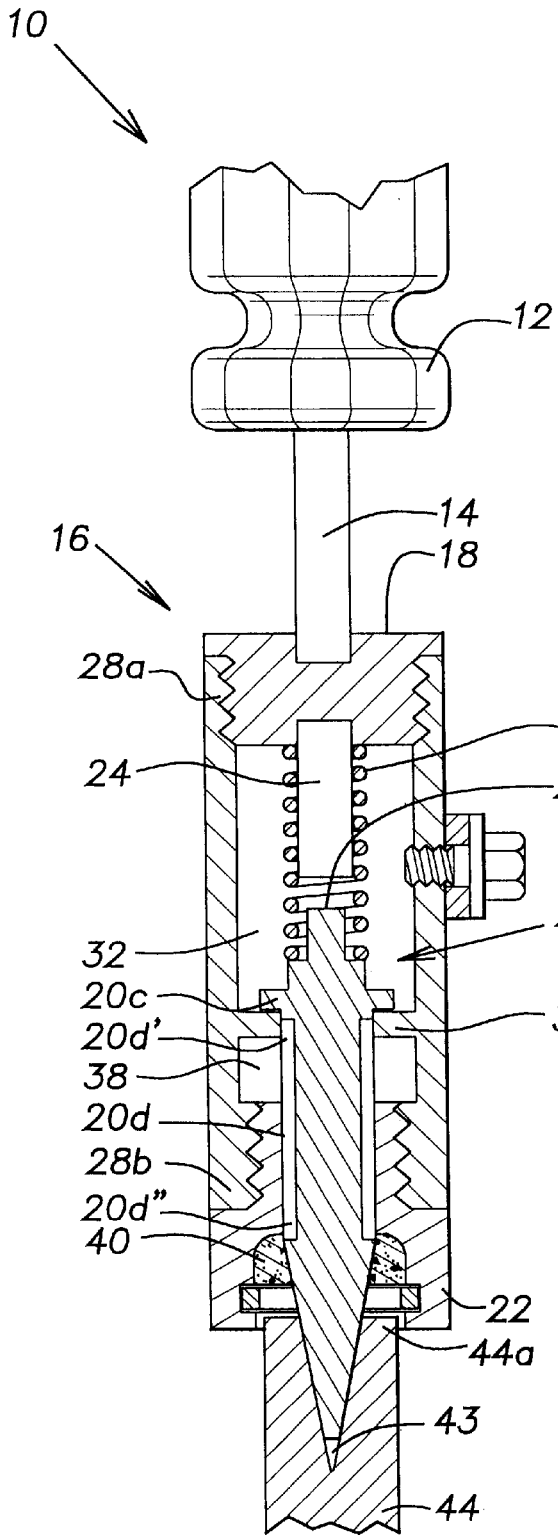
FIG. 2 illustrates the gap checking device in position to check an end gap on a control shaft; and, FIG. 3 illustrates the gap checking device as an end surface of the control shaft has paint applied thereto.
Figure 3:
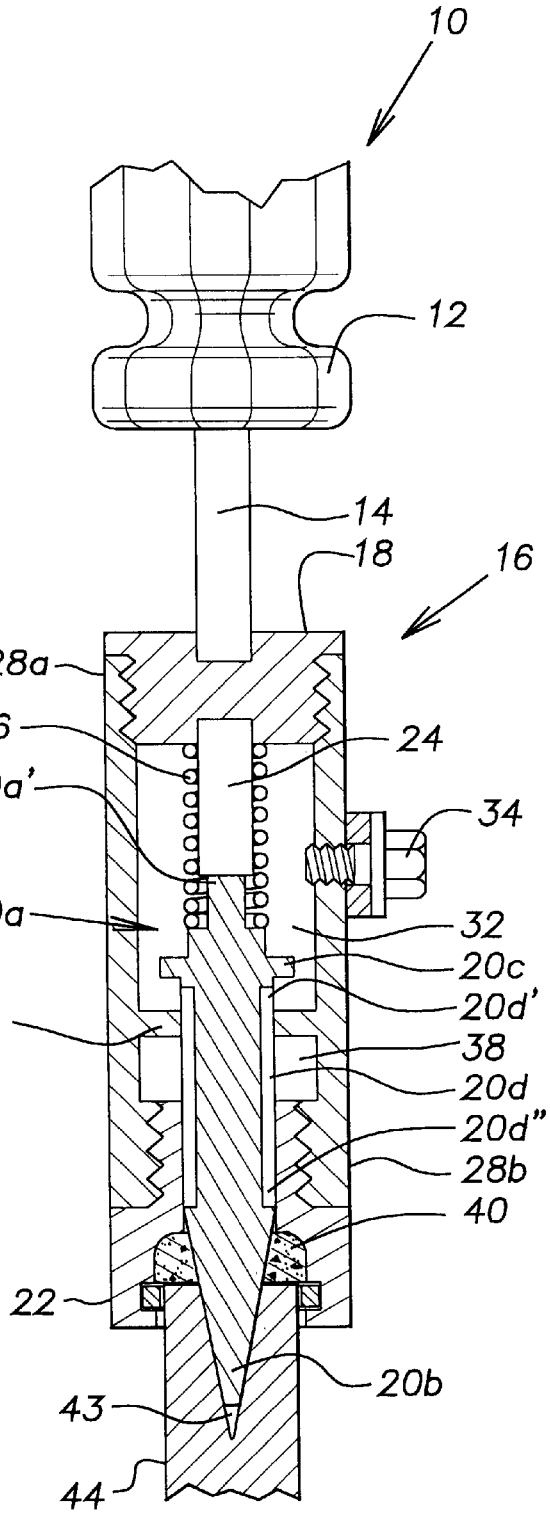

In use of the device 10, and with reference to FIGS. 2–3, user grasps the handle 12 and inserts the gap checking surface of the plunger distal end 20*b* into an opening 43 at the end of a control shaft 44. If the control shaft opening 43 is properly sized, the distal end 20*b* of the plunger 20 extends a predetermined distance into the opening 43. Further axial pressure applied to the handle 12 by the user causes the plunger 20 to move axially against the bias provided by the return spring 26 toward the stop post 24. With reference to FIG. 3, the end surface of the plunger proximal end 20*a* abuts the free end surface of the stop post 24, thereby limiting the travel or stroke of the plunger 20 and defining a full-open position of the plunger 20.

As the plunger 20 moves out of the full closed position (FIG. 2) toward the full-open position (FIG. 3), an annular end surface 44*a* of the control shaft 44 engages the foam paint applicator 40 and is thereby coated with paint. In this regard it is noted that, if the control shaft opening 43 is too small, the distal end 20*b*of the plunger 20, will not be sufficiently inserted into the control shaft 44. Therefore, in this case, the annular end surface 44*a* of the control shaft 44 will not engage the foam paint applicator 40 and, thus, will not be marked. However, it is noted that, when the plunger 20 is in the full open position, further application of axial pressure by the user will drive the plunger distal end 20*b* further into the control shaft opening 43 and may be useful to expand the otherwise narrow control shaft opening, thereby correcting a defective opening size.

In any event, when the plunger 20 moves axially, the annular rim 20*c* is unseated and moved away from the annular wall 30, and the upper end 20*d*' of the longitudinally-extending grooves 20*d* project into the primary paint reservoir 32. Accordingly, paint from the primary paint reservoir 32 flows along the grooves 20*d* and into the secondary paint reservoir 38. Thereafter, when the plunger distal end 20*b* is removed from the control shaft 44, the return spring 26 forces the plunger 20 to move axially and return to its original position (FIG. 2). As such, the annular rim 20*c* is reseated with the annular wall 30 to prevent further paint from flowing from the primary paint reservoir 32. The lower end 20*d*" of the longitudinal grooves 20*d* are now disposed adjacent and in fluid communication with the foam paint applicator 40. Accordingly paint received in the grooves 20*d* and the secondary paint reservoir 38 can flow along the grooves 20*d* and into the foam applicator 40, thereby re-wetting the foam applicator 40 in anticipation of subsequent marking procedures.

Although the present invention has been discussed with particularity herein, it is considered apparent that the present invention is capable of numerous modification, rearrangements, and substitutions of parts without departing from the scope and spirit of the present invention. For example, it is contemplated that the internal annular wall 30 could be eliminated and the annular rim 20*c* could instead seat against the annular face of the guide plug proximal end 22*a* that surrounds the bore. In this case, since the secondary paint reservoir is integrated into the primary paint reservoir, the paint would flow from the primary paint reservoir along the grooves 20*d* when the plunger 20 is moved from the closed position toward the open position and, when the plunger is returned to its normal, closed position by the return spring 26, paint would flow from the grooves 20*d* directly into the foam paint applicator 40. Accordingly, the number, size, and distribution of the grooves 20*d* may need to be enlarged to ensure delivery of a desired volume of paint for each actuation of the plunger 20.

It is further contemplated that the stop post 24 could be eliminated and, instead, the proximal end 20*a* of the plunger 20 could be elongated so that, when the plunger 20 is in its full-open position it engages the inner surface of the end cap 18. Naturally, in this arrangement the inner surface of the end cap 18 will include a structure to positively receive and locate the return spring 26. Such structure could be a short projection or an annular groove, as desired.

Finally, it is contemplated that the end cap 18 could serve as the fill plug and, in that case, the end cap 18 would be removably yet sealingly secured to the first end 28*a* of the sidewall 28. Using the end cap 18 in this fashion would eliminate the necessity of the separate fill plug 34 extending through the sidewall 28, but would require proper reassembly of the return spring 26 each time the end cap 18 is threaded onto the sidewall first end 28*a* and, as such, may be undesirable.

In any event, the foregoing examples illustrate just some of the alternatives that one skilled in the art is capable of realizing using the present invention. Therefore, the present invention is not to be limited to that specifically disclosed herein, but rather is only to be defined by the claims appended hereto.

What is claimed is:

1. A gap checking device, comprising:

a housing defining a paint reservoir;

a plunger having a proximal portion disposed in said housing and a distal portion extending from said housing such that a distal end of said plunger is disposed outside of said housing, said plunger being movable relative to said housing between a first position sealing said paint reservoir and a second position wherein paint received within said paint reservoir may flow from said paint reservoir along said plunger toward said plunger distal end;

a paint applicator disposed within said housing adjacent to said plunger and into which paint flows, said plunger extending away from said paint applicator such that said plunger distal end is spaced from said paint applicator;

wherein said plunger distal end is adapted for insertion into an opening to check a gap formed thereby and, when said gap is correct, a surface adjacent said opening engages said paint applicator and is thereby coated with paint.

2. The gap checking device according to claim 1, wherein the plunger distal end is spaced from the paint applicator a distance such that, when said gap is too small, the surface adjacent said opening fails to engage the paint applicator and is not coated with paint.

3. The gap checking device according to claim 1, wherein said housing comprises an end cap, a guide plug, and a cylindrical sidewall having a proximal end and a distal end, said proximal end receiving said end cap and said distal end receiving said guide plug, said plunger extending through said guide plug and being slidably movable relative to said guide plug.

4. The gap checking device according to claim 3, wherein said end cap has a handle extending therefrom.

5. The gap checking device according to claim 3, wherein an annular wall extends inwardly from said sidewall relatively between said proximal end and said distal end, said annular wall cooperating with said cylindrical sidewall and said end cap to define said paint reservoir.

6. The gap checking device according to claim 5, wherein a proximal end of said plunger is disposed within said paint reservoir.

7. The gap checking device according to claim 6, wherein said plunger proximal end includes a radially extending rim, and said plunger is biased toward a closed position wherein said rim sealingly engages the annular wall.

8. The gap checking device according to claim 7, wherein said plunger has a plurality of grooves formed therein, said grooves extending from adjacent the rim toward the distal end of said plunger and serving to communicate paint from said reservoir to said paint applicator.

9. The gap checking device according to claim 8, wherein said paint applicator is received within a recess formed in said guide plug, said paint applicator being ring shaped and said plunger extending through said paint applicator.

10. The gap checking device according to claim 9, wherein said distal end of said plunger has a shape corresponding to a desired surface profile to be checked.

11. A gap checking device, comprising:

a handle;

a housing assembly secured to said handle, said housing assembly comprising a cylindrical sidewall and an inner annular wall that extends radially inwardly from said cylindrical sidewall, wherein said cylindrical sidewall at least partially defines a paint reservoir and has a proximal end and a distal end, said handle being secured to and extending away from said proximal end of said cylindrical sidewall, said sidewall distal end receiving a guide plug;

a paint applicator disposed within said guide plug and adapted to coat a surface with paint should a gap in said surface match a desired profile; and, a plunger, said plunger having a proximal end disposed in the paint reservoir and a distal end extending from said guide plug, said plunger distal end having a surface that corresponds to the desired profile, said plunger being movable between a closed position wherein said plunger proximal end is seated on said inner annular wall and an open position, wherein said plunger proximal end is unseated from said inner annular wall.

12. The gap checking device according to claim 11, further comprising means to bias the plunger to the closed position.

13. The gap checking device according to claim 12, wherein said guide plug defines a bore through which said plunger extends, said bore issuing into a cavity in which said paint applicator is disposed.

14. The gap checking device according to claim 13, wherein a sidewall of said plunger has a plurality of grooves formed therein, said grooves extending from said proximal end toward said distal end and serving to communicate paint from said paint reservoir to said paint applicator.

15. The gap checking device according to claim 14, wherein said biasing means comprises a spring that is received within said paint reservoir and trapped between an end cap and said plunger proximal end.

16. The gap checking device according to claim 15, further comprising a stop to limit axial movement of said plunger in an open direction.

17. A method of checking a gap in an end surface of a control rod, comprising the steps of:

providing a gap checking device, said device comprising a housing having a proximal end and a distal end, said housing defining a paint reservoir in which a plunger is axially movable, said plunger having a distal end projecting from said housing distal end;

inserting the plunger distal end into the gap in the end surface of the control rod;

pushing the plunger distal end into the gap and forcing the housing distal end to move axially toward the plunger distal end; and, if said gap is properly formed, engaging the end surface of the control rod with a paint applicator and thereby marking said control rod end surface.

18. The method according to claim 17, comprising the further step of:

releasing said housing to permit said housing to move axially away from said plunger distal end.

19. The method according to claim 17, wherein said pushing step includes the steps of:

unseating said plunger from a sealing surface;

permitting paint to flow along said plunger toward the applicator.

20. The method according to claim 17, comprising the further step of:

if said gap is too small, further pushing said plunger distal end toward said control rod so as to enlarge said gap.

21. The method according to claim 20, comprising the further step of:

releasing said housing to permit said housing to move axially away from said plunger distal end.

22. The method according to claim 20, wherein said pushing step includes the steps of:

unseating said plunger from a sealing surface;

permitting paint to flow along said plunger toward the applicator.

* * * * *